US006119487A

United States Patent [19]

Okuno

[11] Patent Number: 6,119,487

[45] Date of Patent: Sep. 19, 2000

[54] METHOD FOR KNITTING DOUBLE JERSEY FABRIC INCLUDING RIB KNITTING AND FABRIC KNITTED BY THE METHOD

[75] Inventor: Masao Okuno, Wakayama, Japan

[73] Assignee: Shima Seiki Manufacturing Limited, Wakayama, Japan

[21] Appl. No.: 09/353,363

[22] Filed: Jul. 15, 1999

[30] Foreign Application Priority Data

Jul. 15, 1998 [JP] Japan ..... 10-200626

[51] Int. Cl.[7] ..... D04B 7/30

[52] U.S. Cl. ..... 66/75.1; 66/64; 66/172 R; 66/197

[58] Field of Search ..... 66/60 R, 64, 200, 66/172 R, 199, 75.1, 197

[56] References Cited

U.S. PATENT DOCUMENTS 5,537,843 7/1996 Okuno ..... 66/64

5,587,848 12/1996 Shimotashiro et al. ..... 360/46

*Primary Examiner*—Danny Worrell

*Attorney, Agent, or Firm*—Arent Fox Kintner Plotkin & Kahn PLLC

[57] ABSTRACT

To provide improved beauty of an double jersey fabric at its side edge portion and improved productivity, the present invention provides a method for knitting the double jersey fabric including rib knitting such as Milano rib by a knitting equivalent to or higher than a double knitting by use of a flat knitting machine, wherein a piping is provided for at least one of a side edge portion of the fabric by the step that one or more needles of the front and back needle beds are introduced so that knitting of the side edge portion of the fabric on an ending side of a course knitting can be ended with the needle(s) of one of the needle beds and knitting of the side edge portion of the fabric on a beginning side of the subsequent course knitting can be started with the needle(s) of the other of the needle beds; and the step that the course knitting are performed orderly from the yarn feeder disposed on a frontwardly positioned track, when the knitting of the side edge portion is ended with the needle(s) of the back needle bed, while on the other hand, the course knitting are performed orderly from the yarn feeder disposed on a rearwardly positioned track, when the knitting of the side edge portion is ended with the needle(s) of the front needle bed.

3 Claims, 7 Drawing Sheets

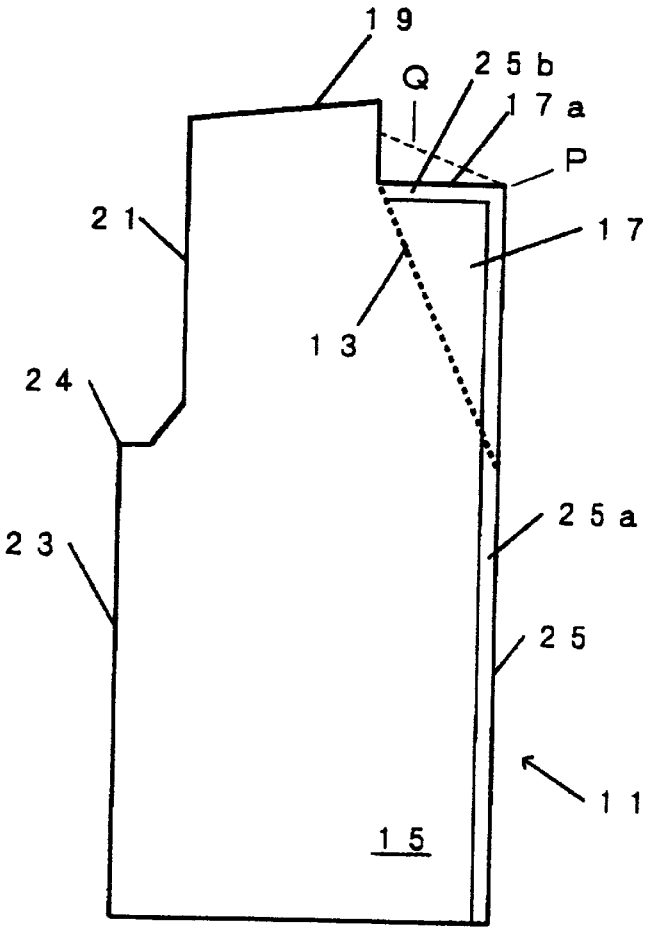
Fig. 3—a
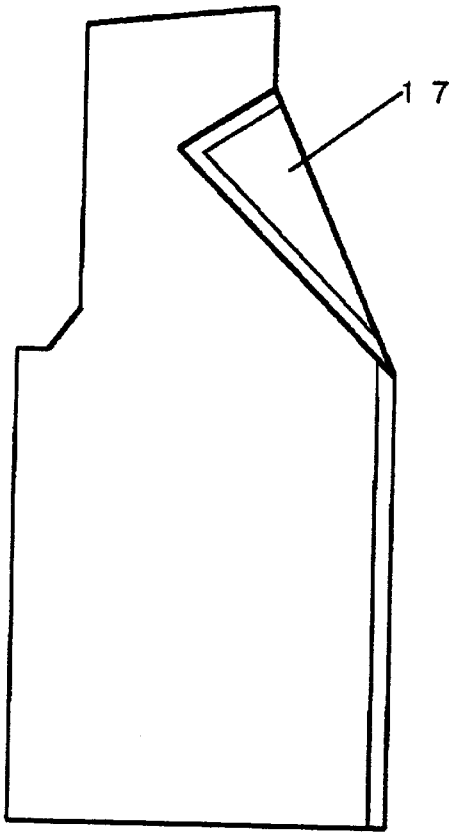
Fig. 3—b

Prior art

METHOD FOR KNITTING DOUBLE JERSEY FABRIC INCLUDING RIB KNITTING AND FABRIC KNITTED BY THE METHOD

BACKGROUND OF THE INVENTION

1. Field of the Invention

The present invention relates to a method for knitting an double jersey fabric including a rib knitting such as Milano rib by use of a flat knitting machine comprising at least a pair of front and back needle beds and a yarn feeder, and to a fabric knitted by the method. Especially, the present invention is directed to improvements in beauty of side edges or hems of the knitted fabric and in productivity.

2. Description of the Related Art

Milano rib is known as one of double jersey fabrics including rib knitting. The Milano rib has a basic knitting structure formed by the knitting of three courses of a back plain knitting, a front plain knitting and a rib knitting and has the advantage that by repetition of the basic knitting, excessive horizontal stretchability of the fabric which would be caused by the exclusive use of the rib knitting can be prevented by the plain knitting, to ensure form-stability of the fabric. The fabrics having this advantage are used as a material for collars and knitted suits.

Shown in FIG. 6 is a known knitting step of the Milano rib. This knitting step is the so-called single knitting in which a yarn is used in each forward movement or backward movement of a carriage, so that only a single course is knitted. The basic knitting of the Milano rib is completed with three movements of the carriage. As illustrated, in the step 1, a yarn (a yarn feeder) is moved to the outside of the fabric on the right-hand side and is fed to needles a–n of a back needle bed, for the knitting of a first back plain knitting course 101 of the Milano rib. In the step 2, the carriage is reversed to move the yarn to the outside of the fabric on the left-hand side, so as to feed the yarn to the needles M–A of a front needle bed, for the knitting of the next front plain knitting course 102. In the step 3, the carriage is reversed again to move the yarn to the outside of the fabric on the right-hand side, so as to feed the yarn zigzag to the needles A–M of the front needle bed and the needles a–n of the back needle bed, for the knitting of the rib knitting course 103. The knitting shown in the steps 1–3 are repeated to knit subsequent courses 104, 105, 106 . . . , so that the fabric having the Milano rib as a knitting structure is produced. In this known method, no particular process is given to the side edges of the fabric.

The structure of the knitted loops of the Milano rib thus knitted is shown in FIG. 7 viewed from the above of the needle beds of the flat knitting machine.

A needle n of the back needle bed is used in starting to knit the back plain knitting course 104 subsequent to the rib knitting course 103, and the needle is the same as the needle last used in knitting the rib knitting course 103. Because of this, a prolongation 110 will extend from a knitted loop 103*n* formed at the end of the rib knitting to the subsequent knitted loop 104*n* formed in the same wale. The same phenomenon presents in the form of a prolongation 111 between the subsequent rib knitting course 106 and the subsequent rib knitting course 107. When the double jersey fabric including the rib knitting, not limited to the Milano rib, is knitted, it is inevitable that the same needle is introduced in the knitting of a succession of courses as mentioned above. This causes the prolongation to protrude outward at the side edges of the fabric, thus becoming a cause of spoiling the beauty of the fabric at the side edges thereof. Also, because of the knitting by the single knitting, the productivity is significantly reduced.

It may be a practical way for improved productivity that the double knitting using two yarns or the triple knitting using three yarns is used as a substitute for the abovesaid single knitting. However, such a way involves the occurrence of the prolongation, combined with the phenomenon of the yarns entangling among themselves at the side edges of the fabric, thus producing the disadvantage of further spoiling the beauty of the fabric.

SUMMARY OF THE INVENTION

In consideration of the disadvantages involved in the prior art, the present invention has been made. It is the object of the present invention to provide a knitting method for enabling improved beauty of the side edges of the double jersey fabric including the rib knitting such as Milano rib and providing improved productivity and to provide the fabric knitted by the method.

To accomplish the abovesaid object, the present invention provides a novel method for knitting an double jersey fabric including rib knitting such as Milano rib by a knitting equivalent to or higher than a double knitting by use of a flat knitting machine comprising at least a pair of oppositely disposed, front and back needle beds and two or more yarn feeders disposed on tracks of yarn guide rails on the needle beds to move over the needle beds so as to feed yarns to the needles on the needle beds, wherein a piping is provided for at least one side edge portion of the fabric by the following steps:

(a) that one or more needles of each of the front and back needle beds are introduced so that knitting of the side edge portion of the fabric on an ending side of a course knitting can be ended with the needle(s) of one of the needle beds and knitting of the side edge portion of the fabric on a beginning side of the subsequent course knitting can be started with the needle(s) of the other of the needle beds; and (b) that the course knitting are performed orderly from the yarn feeder disposed on a frontwardly positioned track, when the knitting of the side edge portion is ended with the needle(s) of the back needle bed, while on the other hand, the course knitting are performed orderly from the yarn feeder disposed on a rearwardly positioned track, when the knitting of the side edge portion is ended with the needle(s) of the front needle bed.

In the method, a second piping subsequent to the piping formed at the side edge portion is formed at an upper portion of the fabric by a bind-off process.

Also, the present invention provides a novel fabric knitted by the method by which a piping comprising at least two wales is formed at a side edge portion of an double jersey fabric including rib knitting such as Milano rib knitted by a knitting equivalent to or higher than a double knitting by use of two or more different yarns and also is formed in such a manner that the yarns can be prevented from entangling among themselves at the end of the fabric and also can extend continuously along the direction of their courses.

BRIEF DESCRIPTION OF THE DRAWINGS

These and other objects and advantages of the invention will become more apparent upon a reading of the following detailed description and drawings, in which:

FIG. 3 is a view showing an application of the inventive method to the knitting of a knitted suit, FIG. 3-*a* showing a right half of the knitted suit as completed in knitting; and FIG. 3-*b* showing an actual use state of the same as folded along a broken line of FIG. 3-*a* to form the collar;

DETAILED DESCRIPTION OF THE PREFERRED EMBODIMENT

With reference to the accompanying drawings, an example of the preferred embodiment of the knitting method of the present invention and an example of the fabric knitted by the inventive method will be described below.

EMBODIMENT 1

This embodiment is one example of the knitting method of the present invention applied to a collar, in which Milano rib as an double jersey fabric structure including the rib knitting is used.

Figure 1:
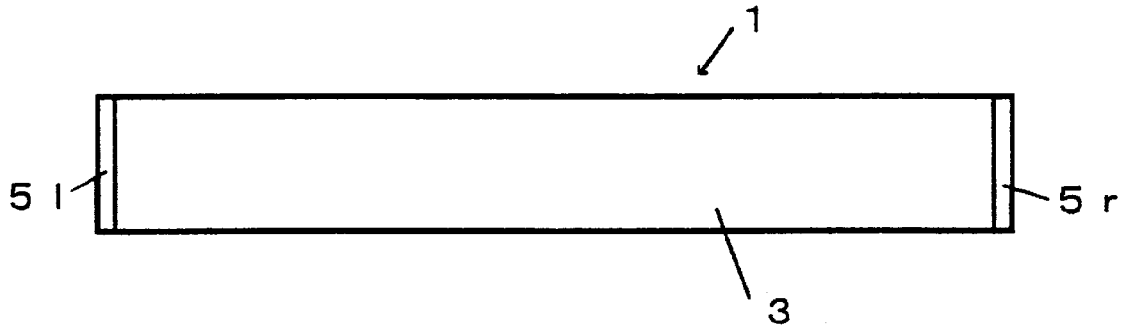
FIG. 1 is a view showing a collar of Embodiment 1.
Figure 2:
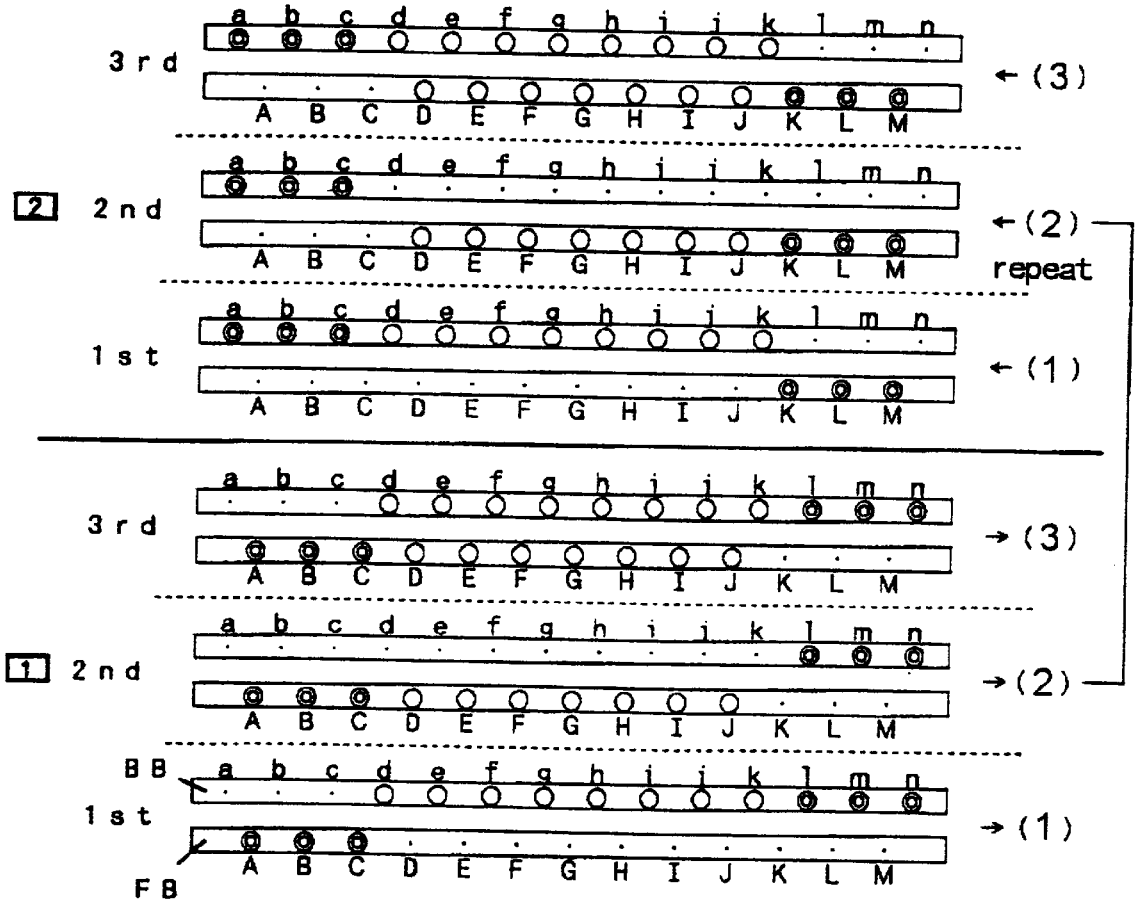
FIG. 2 is a view showing the knitting steps of the collar.

FIG. 1 shows a fabric 1 to be knitted into a collar, and FIG. 2 shows the steps for knitting the collar 1. A flat knitting machine used for the knitting of the Embodiment comprises at least a pair of oppositely disposed needle beds; two or more yarn feeders disposed on tracks of yarn guide rails on the needle beds to move over the needle beds so as to feed yarns to the needles on the needle beds; and a carriage having three cam systems to enable a triple knitting. This produces the result that the basic knitting of the Milano rib comprising three courses of a rib knitting, a front plain knitting and a back plain knitting is completed with each forward or backward movement of the carriage.

In FIG. 2, alphabets A–M denote needles of the front needle bed FB of the needle beds oppositely disposed in front and back, and alphabets a–n denote needles of the back needle bed BB, respectively. The ordinal numbers "1st", "2nd" and "3rd" shown in the left side of the diagram denote cam systems occurring from the leading side of the direction for the carriage to move forward. The arrows shown in the right side of the diagram indicate the direction for the carriage to move forward, and the numerals 1, 2 and 3 in the brackets indicate the track numbers of the yarns (yarn feeders) moving in reciprocation over the yarn guide rails (not shown) provided on the needle beds. As to the track numbers of the yarns, 1 denotes a yarn at a frontward side of the knitting machine and a higher number denotes a yarn at the rearward side of the knitting machine. As to symbols shown in the diagram, ○ indicates a knitted loop of a body 3 of the collar and ◎ indicates knitted loops at side edge portions 5*r*, 5*l* of the body 3 of the collar at the opposite ends thereof. The side edge portions 5*r*, 5*l* are formed into the form of a hollow piping, as mentioned later. For purposes of explanatory convenience, a smaller number of needles than those actually used in the knitting of the collar are shown in the diagram.

Now, the description on how to knit the collar will be given below. First, in the step 1, the knitting is started from the left side of the fabric along the course along which the carriage is moved rightward. In a leading cam system (or 1st cam system), the yarn 1 is used for the knitting. The course formed is a course of the back plain knitting of the Milano rib. The yarn is fed to the needles A–C of the front needle bed, to do the front knitting of the left side edge portion 5*l* of the fabric and, thereafter, the yarn is fed to the needles d–n of the back needle bed, to do the back knitting of the body 3 and the right side edge portion 5*r* of the fabric. In an intermediate cam system (2nd cam system), the yarn 2 is used for the knitting. The course formed is a course of the front plain knitting for the body 3. The yarn is fed to the needles A–J of the front needle bed, to do the front knitting of the left side edge portion 5*l* of the fabric and the body 3 and, thereafter, the yarn is fed to the needles l–n of the back needle bed, to do the back knitting of the right side edge portion 5*r* of the fabric. In a trailing cam system (3rd cam system), the yarn 3 is used for the knitting. The course formed is a course of the rib knitting for the body 3. The yarn is fed to the needles A–C of the front needle bed, to do the front knitting of the left side edge portion 5*l* of the fabric and, thereafter, the yarns are fed to the needles d–k of the back needle bed and the needles D–J of the front needle bed, to do the rib knitting of the body 3 of the fabric. Thereafter, the yarn is fed to the needles l–n of the back needle bed, to do the back knitting of the right side edge portion 5*r* of the fabric. This way of knitting produces the knitting structure of Milano rib for the body 3 and also provides a series of knitting courses formed by the front knitting for the left side edge portion 5*l* of the fabric and a series of knitting courses formed by the back knitting for the right side edge portion 5*r* of the fabric.

In the step 2, the knitting is started from the right side of the collar 1 along the course along which the carriage is moved leftward. In the step 2 as well, the cam systems, yarns and knitting structure of the Milano rib in the body 3 of the collar 1 which are identical in relationship to those in the step 1 are used. The leading cam system uses the yarn 1 for the back plain knitting; the intermediate cam system uses the yarn 2 for the front plain knitting; and the trailing cam system uses the yarn 3 for the rib knitting.

In the leading (1st) cam system, the yarn is fed to the needles M–K of the front needle bed, to do the front knitting of the right side edge portion 5*r* of the fabric and, thereafter, the yarn is fed to the needles k–d of the back needle bed, to knit the body 3 and then the yarn is fed to the needles c–a of the back needle bed to provide the back knitting of the left side edge portion 5*l* of the fabric. In the intermediate (2nd) cam system, the yarn is fed to the needles M–D of the front needle bed, to do the front knitting of the right side edge portion 5*r* of the fabric and the body 3 and, thereafter, the yarn is fed to the needles c–a of the back needle bed, to do the back knitting of the left side edge portion 5*l* of the fabric. In the trailing (3rd) cam system, the yarn is fed to the needles M–K of the front needle bed, to do the front knitting of the right side edge portion 5*r* of the fabric and, thereafter, the yarns are fed to the needles k–d of the back needle bed and the needles J–D of the front needle bed, to do the rib knitting of the body 3 of the fabric. Thereafter, the yarn is fed to the needles c–a of the back needle bed, to do the back knitting of the left side edge portion 5*l* of the fabric. This knitting way produces the body 3 of the fabric of the Milano rib and also provides a series of knitting courses formed by the back knitting for the left side edge portion 5*l* of the fabric and a series of knitting courses formed by the front knitting for the right side edge portion 5*r* of the fabric.

By repetition of the knitting steps 1 and 2, hollow piping portions are formed at opposite edge portions of the fabric body 3 of the Milano rib. While in illustration the piping is formed with three front needles and three back needles from each of the left and right side edges of the fabric, or a total of six needles in all, the piping may be provided by use of at least one needle arranged in front and back. It is desirable that the knitted loops of the edge portions 5 are adjusted in size to match with textures of the body 3 of the fabric, when necessary. In the piping, the courses are formed in sequence in the side edge portion 5*l* of the fabric by use of the yarns 1, the yarn 2 and the yarn 3 in the form of a series of knitted loops being arranged in a row in the shape of C along the direction of the courses in the left side edge portion 5*l* by use of the needles c–a of the back needle bed at which the knitting of the courses are ended and the needles A–C of the front needle bed from which the knitting of the subsequent courses are started. This enables the yarns to be prevented from entangling among themselves at the edge portion 5*l* of the fabric, thus contributing to an aesthetically good-quality fabric thereat. Likewise, in the right side edge portion 5*r*, the courses are formed in the form of a series of courses by use of the needles l–m of the back needle bed and the needles M–K of the front needle bed subsequent to the needle n, thus contributing to an aesthetically good quality fabric thereat. It should to be noted that in a case where the needles of the front needle bed are used as those for the knitting to be ended at and the piping is formed by feeding the yarns to the needles in the order of K–M to n–l at the right side edge portion 5*r* and in the order of C–A to a–c at the left side edge portion 5*l*, the yarns 1, 2 and 3 are assigned to the trailing cam system, the intermediate cam system and the leading cam system, respectively, to prevent the yarns from entangling among themselves.

APPLICATIONS

An example of the knitting method of the present invention applied to a knitted suit 11 will be described below with referring to FIG. 3 showing a right half of the knitted suit 11; FIG. 3-*a* showing the knitted suit as completed in knitting and FIG. 3-*b* showing an actual use state of the same as folded along a crease line 13 indicated by a broken line of FIG. 3-*a* to form the collar 17. A right-hand front body 15 is joined with a separately knitted, back body and sleeves (not shown) by seaming, but is not given any piping at its parts including the left side edge portion of the fabric to be seamed for a finished article (a shoulder line 19, an armhole 21 and a side line 23), because these parts are hidden in the back of the article when brought into a finished article. On the other hand, the opening side (right side edge portion) 25 of the right-side front body 15 including the collar 17 is given the piping, because the opening side itself is finished in the form of the end-product.

Figure 4:
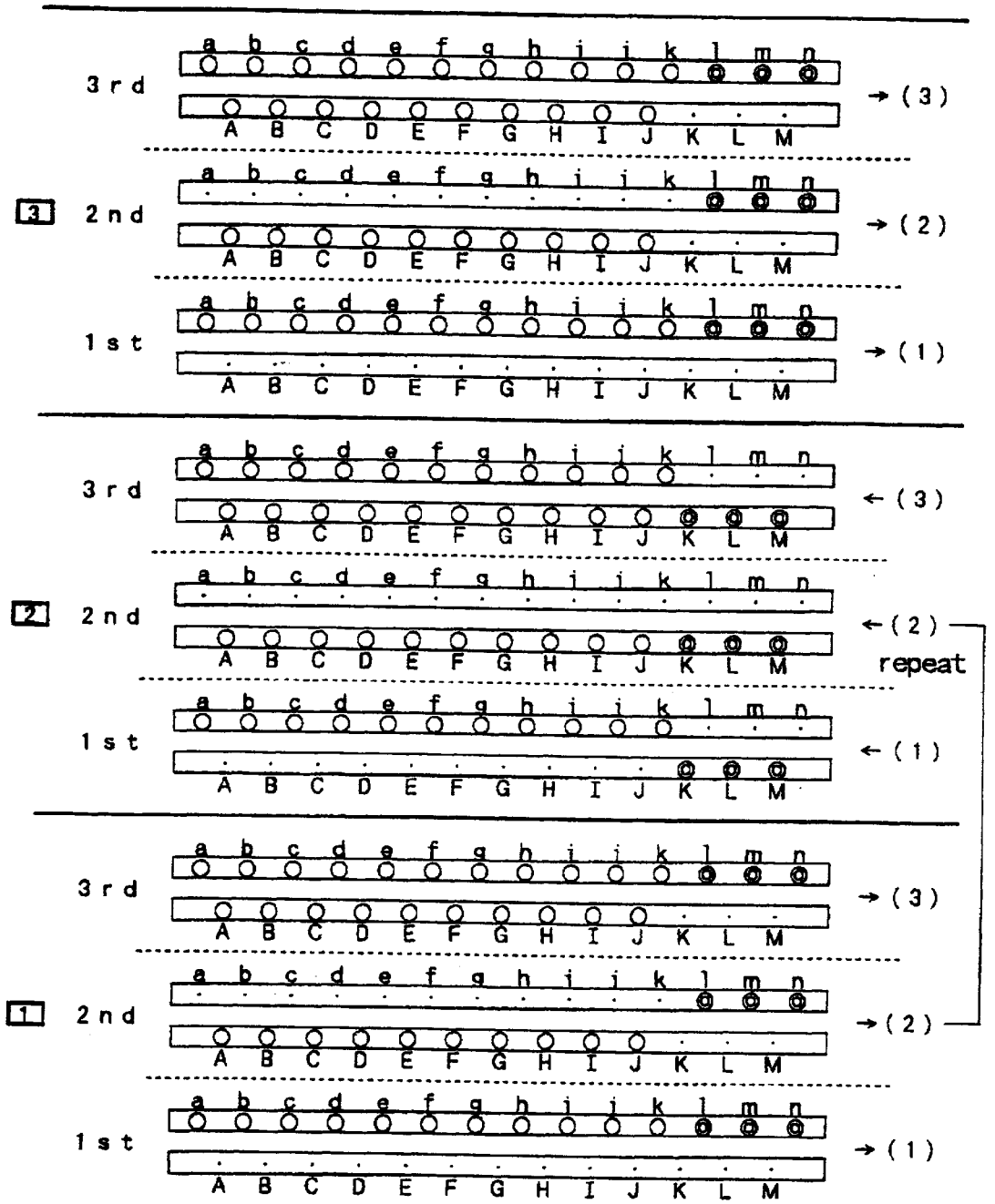
FIG. 4 is a view showing the first half of the knitting steps of the application.
Figure 5:
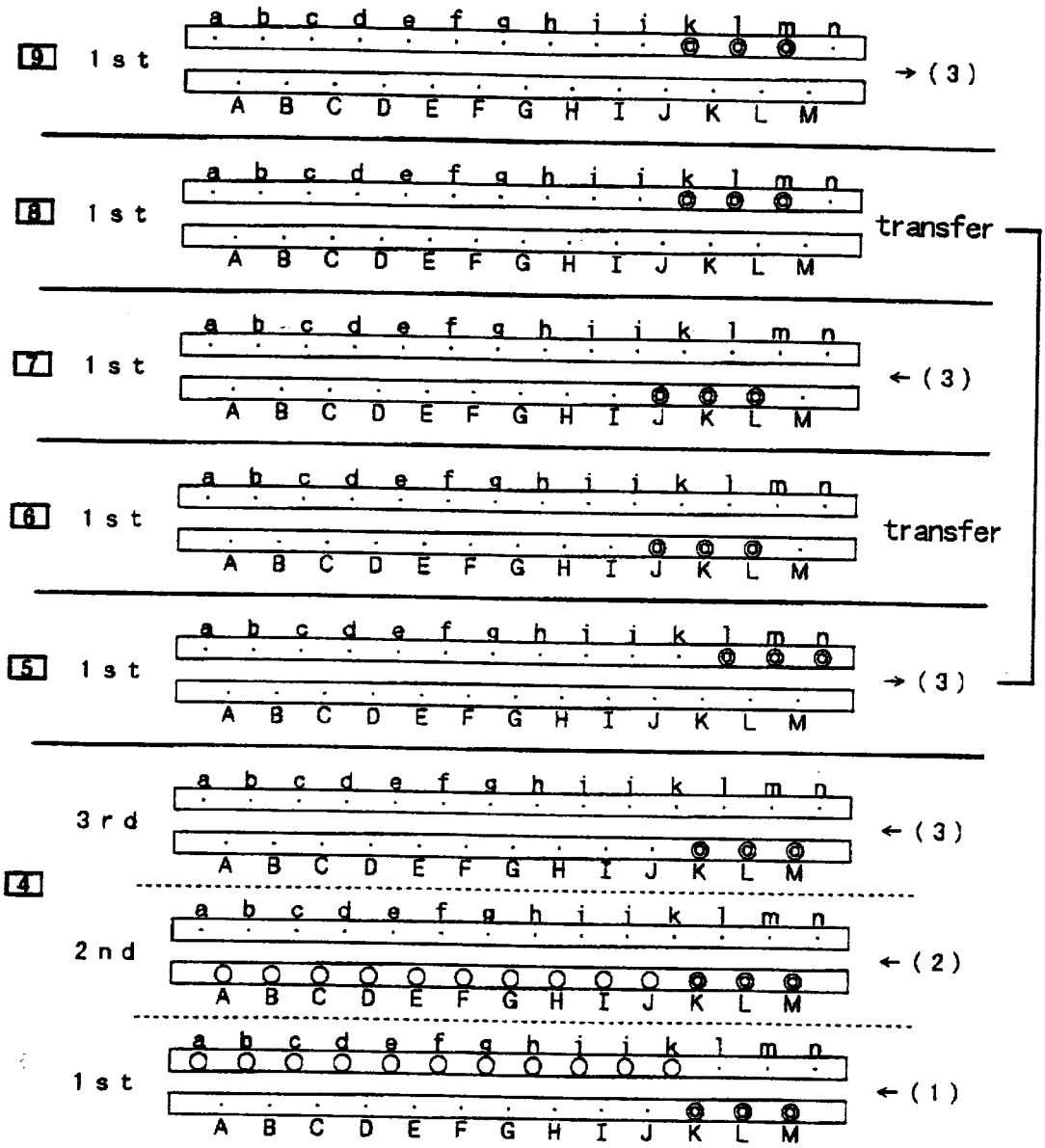
FIG. 5 is a view showing the second half of the knitting steps of the application.
Figure 6:
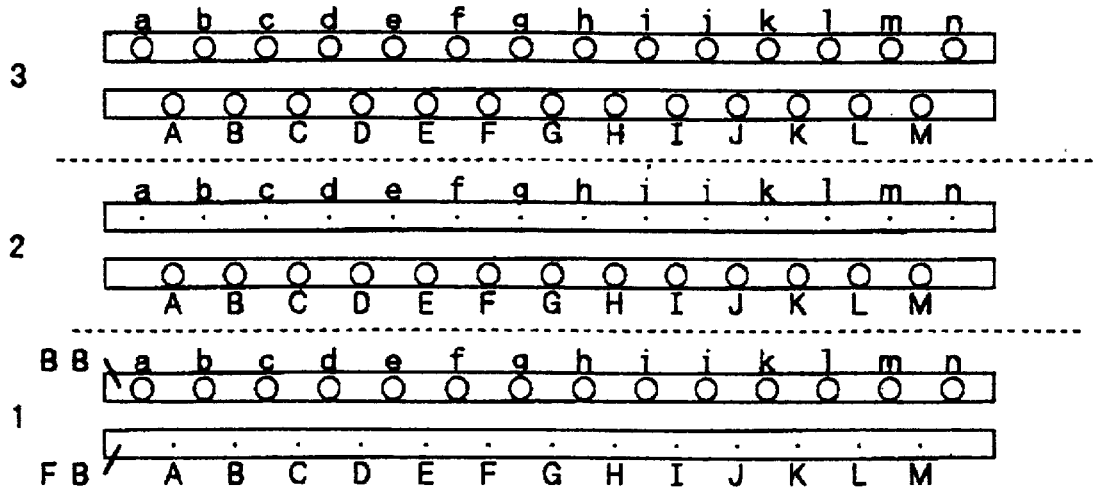
FIG. 6 is a view showing the knitting steps of Milano rib by a known method.
Figure 7:
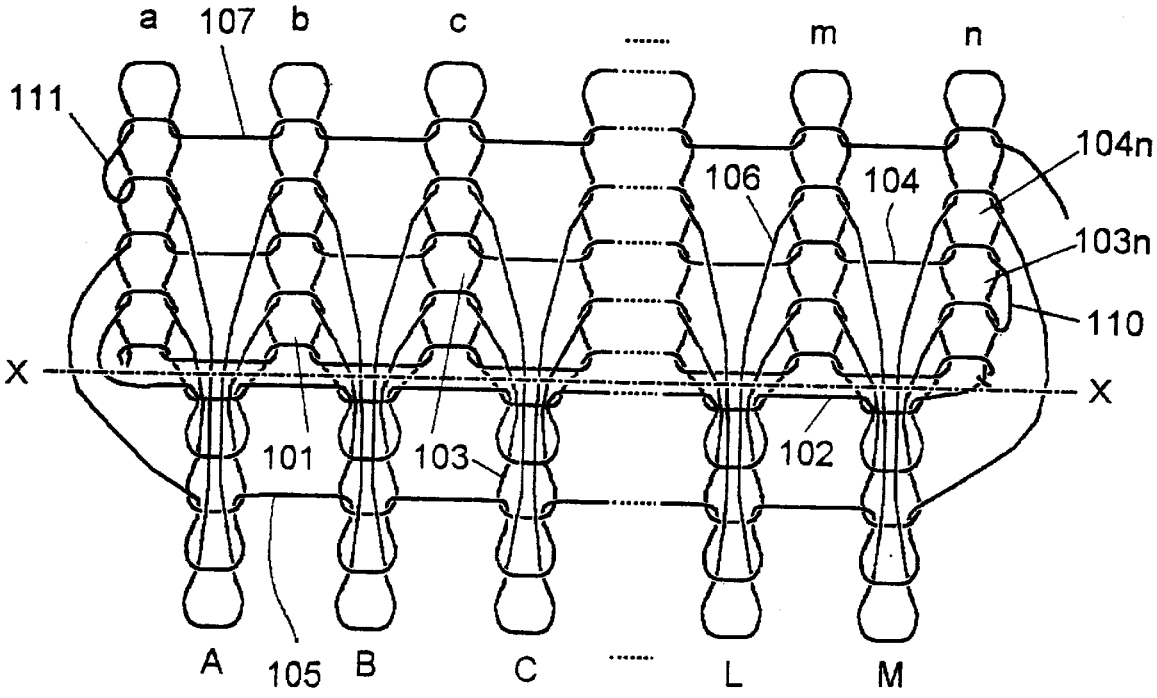
FIG. 7 is a view of the structure of the knitted loops of Milano rib formed by the known method as viewed from the above of the needle beds of the flat knitting machine.

The knitting steps for the right-side front body 15 which are knitted in the above-described manner will be described with reference to FIGS. 4 and 5. The knitting steps 1 and 2 shown in FIG. 4 are identical to the steps 1 and 2 of FIG. 2 of the aforesaid Embodiment 1, except the omission of the piping at the left side edge portion of the fabric. By repetition of the knitting, the knitting proceeds to a side seam portion 24 of the body. Between the knitting step 1 and the knitting step 2, the step for narrowing the knitting width from the side seam portion 24 is inserted to form the armhole 21 and knit the course before the folded portion of the collar at the upper end 17*a*. In the subsequent step 3, the go-right course is knitted and the yarns 1–3 are stopped at the right-hand side of the fabric 15.

Shown as the steps 4–9 are the knitting steps for the course of the end portion of the collar 17*a* and for the bind-off process to prevent the course of the end portion of the collar 17*a* from raveling out. First, in the step 4, the yarns 1, 2 are taken to knit the courses by the leading cam system and the intermediate cam system, while being moved to the left side of the fabric. Simultaneously, the yarn 3 is used and fed to the needles M–K of the front needle bed for doing the front knitting by the trailing cam system.

The bind-off process is performed with the single knitting switched from the triple knitting, while using the yarn 3. For the bind-off process hereat, a second piping 25*b* subsequent to a piping 25*a* firstly formed in the right edge portion of the right-hand front body 15 is formed on the upper end 17*a* of the collar to provide the bind-off process for the entire edge of the collar. In the step 5, the yarn is fed to the needles l–n of the back needle bed to do the back knitting. In the next step 6, the knitted loops which are retained by the needles K, L, M of the front needle bed for which the front knitting is provided in the step 4 are transferred to the needles J, K, L of the front needle bed placed inside of the fabric. In the step 7, the yarn is fed to the needles L–J of the front needle bed, to form knitted loops subsequent to the transferred loops. In the step 8, the knitted loops which are retained by the needles l, m, n of the back needle bed for which the back knitting is provided in the step 5 are transferred to the needles k, l, m of the back needle bed placed inside of the fabric.

For transference of the knitted loops for the bind-off process, the step is introduced in which the knitted loops are retained to a transfer jack bed, not shown, for a while, and thereafter the same bed is racked to transfer the knitted loops to the neighboring needles of the initial needle bed. The illustration of this step is omitted. The transfer jack bed is an auxiliary bed having transfer jacks which are arranged in series over the needle beds for transference of the loops. The transfer jack bed is mounted in a computer aided flat knitting machine e.g. SES-122RT (product name) available from SHIMA SEIKI MFG., LTD. In the case of a flat knitting machine having only a pair of front and back needle beds as in the illustrated embodiment, for example, the front knitting is done by use of the odd-numbered needles of the front needle bed and the back knitting is done by use of the even-numbered needles of the back needle bed, whereby the alternate needles of each of the front and back needle beds can be used to knit the fabric. This enables the transferring empty needles to be provided on the opposing beds, so that the knitted loops can be transferred by use of those transferring empty needles.

By this way of knitting, the number of wales (or the number of associated needles) of the edge portion of the collar 17*a* are reduced by one orderly. Similar knitting steps to the above-mentioned steps 5–8 are repeated for the needles which are kept being used until all wales of the edge portion 17*a* of the collar are subjected to the bind-off process, before the knitting for the edge binding of the edge portion 17*a* of the collar is ended. Thereafter, though not illustrate, the yarn 3 is used to produce a go-left rib knitting course of the Milano rib subsequent to the leading course and the intermediate course in the step 4 and then the yarns 1, 2, 3 are all aligned at the left side of the fabric. Thereafter, the knitting proceeds to the shoulder line 19, while doing the triple knitting again, whereby the knitting of the right-hand front body 15 is ended.

The above discusses on the bind-off process for the collar pattern having an angle P of 90 degree, which is subjected to the bind-off process every time each course of piping is formed by the single binding. On the other hand, for the upper edge portion of the collar having a collar pattern as indicated by a broken line Q in FIG. 3, the upper edge portion of the collar becomes longer than 17*a*. In this case, the "flechage knitting" is performed in which the needles are rendered inoperative orderly from the needles on the side of the edge portion of the collar, while the courses of the body portion 15 and the collar portion 17 are formed so that the collar can have such a contour as indicated by the broken line Q, and then the bind-off process is performed. Since the upper edge portion of the collar becomes longer than 17*a*, as mentioned above, the lengths of the knitted loops in the piping portion are adjusted longer to that extent. If only the adjustment in length of the knitted loops is not enough, then the bind-off process is performed in accordance with the angle of the corner of the collar and the length of the upper edge portion of the collar, every time two or three courses of the piping are formed. In this case, the double knitting or the triple knitting may be used as a substitute for the single knitting, to form the piping in such a condition that the yarns can be prevented from entangling among themselves at the end, as is the case with the form of the first piping.

Though in the above-illustrated embodiment and its application, the description on the example that the triple knitting is used for the double jersey fabric of Milano rib so that the basic knitting of the Milano rib can be completed at each forward movement or backward movement of the carriage is given, the knitting method of the present invention is not limited to the application to the Milano rib, but is applicable to other rib knitting such as Half milano rib, Pique and Ponti rome. Also, the knitting method of the present invention is also applicable to the case where the rib knitting knitted by use of all needles undergo the double knitting or triple knitting.

As seen from the forgoing, according to the present invention, occurrence of the prolongation at the side edge portion of the double jersey fabric including the rib knitting can be avoided and also the yarns can be prevented from entangling among themselves thereat, so that improved beauty of the fabric and improved productivity can be produced.

While the preferred embodiments of the invention have been described, it is to be understood that various changes and modifications may be made in the invention without departing from the sprit of the present invention. The scope of the invention, therefore, is to be determined solely by the following claims.

What is claimed is:

1. A method for knitting a double jersey fabric including rib knitting by a knitting no less than a double knitting by use of a flat knitting machine comprising at lease a pair of oppositely disposed, front and back needle beds and two or more yarn feeders disposed on tracks of yard guide rails on the needle beds to move over the needle beds so as to feed yarns to the needles on the needle beds, characterized in that a piping is provided for at least one side edge portion of the fabric, the method comprising the following steps:

(a) introducing one or more needles of each of the front and back needle beds so that knitting of the at least one side edge portion of the fabric on an ending side of a course knitting can be ended with the needle(s) of one of the needle beds and knitting of the at least one side edge portion of the fabric on a beginning side of the subsequent course knitting can be started with the needle(s) of the other of the needle beds; and (b) performing the course knitting either by starting from the yarn feeder disposed on a frontwardly positioned track when the knitting of the at least one side edge portion is ended with the needle(s) of the back needle bed or by starting from the yarn feeder disposed on a rearwardly positioned track when the knitting of the side edge portion is ended with the needle(s) of the front needle bed.

2. The method for knitting an double jersey fabric including rib knitting according to claim 1, wherein a second piping subsequent to the piping formed at the at least one side edge portion is formed at an upper portion of the fabric by a bind-off process.

3. A fabric wherein a piping comprising at least two wales is formed at a side edge portion of an double jersey fabric including rib knitting knitted by a knitting no less than a double knitting by use of two or more different yarns and also is formed such that the yarns are prevented from entangling among themselves at the end of the fabric and extend continuously along the direction of their courses, wherein a second piping subsequent to a piping formed at an at least one side edge portion is formed at an upper portion of the fabric by a bind-off process.

* * * * *